US012025048B2

(12) United States Patent
Billich et al.

(10) Patent No.: US 12,025,048 B2
(45) Date of Patent: Jul. 2, 2024

(54) APPARATUS AND METHOD FOR OPERATING A VEHICLE COOLING SYSTEM

(71) Applicant: DEERE & COMPANY, Moline, IL (US)

(72) Inventors: Manuel Billich, Dischingen (DE); Michael Meid, Waghaeusel (DE)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 18/159,874

(22) Filed: Jan. 26, 2023

(65) Prior Publication Data

US 2023/0304433 A1 Sep. 28, 2023

(30) Foreign Application Priority Data

Mar. 23, 2022 (DE) ..... 102022106777.7

(51) Int. Cl.
*F01P 7/04* (2006.01)

(52) U.S. Cl.
CPC ..... *F01P 7/04* (2013.01)

(58) Field of Classification Search
CPC ..... F01P 7/04
See application file for complete search history.

(56) References Cited

U.S. PATENT DOCUMENTS 8,960,349 B2 2/2015 Sherlock
9,586,473 B2 3/2017 Pfohl et al.
9,599,009 B2 3/2017 Smemo et al.
2012/0055170 A1* 3/2012 Lilke ..... F24H 3/0411 165/61
2013/0153180 A1 6/2013 Montocchio et al.
2014/0223933 A1* 8/2014 Steele ..... B60H 1/00014 165/41
2015/0017901 A1* 1/2015 Pfohl ..... E02F 9/2095 180/68.2

(Continued)

FOREIGN PATENT DOCUMENTS

DE 102014208553 A1 11/2015
EP 2757233 A1 7/2014
FR 3093303 A1 9/2020

OTHER PUBLICATIONS

European Search Report issued in application No. 23160117.0, dated Sep. 7, 2023, 5 pages.

*Primary Examiner* — Long T Tran

(57) ABSTRACT

A vehicle cooling system includes a first fan assembly, a second fan assembly, and a control unit. The first fan assembly generates a main cooling flow acting upon a first cooler arrangement. The second fan assembly generates a secondary cooling flow adjacent to the main cooling flow and acting upon a second cooler arrangement. The secondary cooling flow is branched off from the main cooling flow via the second fan assembly. The main and secondary cooling flows pass through a filter element located upstream of the first and second fan assemblies and the first and second cooler arrangements. The control unit is configured to determine an actual value of a rotational speed variable of the second fan assembly, compare the actual value with a desired value specified for a cleaned state of the filter element, and generate a trigger signal to initiate a reversing operation of the first fan assembly.

16 Claims, 3 Drawing Sheets

(56) References Cited

U.S. PATENT DOCUMENTS

| | | | | |
|---|---|---|---|---|
| 2017/0112054 | A1 | 4/2017 | Miller et al. | |
| 2019/0184811 | A1* | 6/2019 | Ivey | B60K 11/04 |
| 2020/0338979 | A1* | 10/2020 | Mussack | B60K 11/085 |

* cited by examiner

APPARATUS AND METHOD FOR OPERATING A VEHICLE COOLING SYSTEM

CROSS-REFERENCE TO RELATED APPLICATIONS

This application claims priority to German Patent Application No. 102022106777.7, filed Mar. 23, 2022, which is hereby incorporated by reference.

FIELD OF THE DISCLOSURE

The disclosure relates to an apparatus and a method for operating a vehicle cooling system.

BACKGROUND

Agricultural or industrial utility vehicles can have a cooling system for cooling an internal combustion engine.

SUMMARY

The disclosure relates to an apparatus and a method for operating a vehicle cooling system which comprises a first fan assembly for generating a main cooling flow acting upon a first cooler arrangement, and a second fan assembly which is adjacent to the main cooling flow for generating a secondary cooling flow acting upon a second cooler arrangement, the secondary cooling flow being branched off from the main cooling flow by means of the second fan assembly, and the ambient air taken in for generating the cooling flows passing through a filter element which is located upstream of the fan assemblies and of the cooler arrangements for filtering particles.

A vehicle cooling system of this type can be used, inter alia, in R series agricultural tractors from John Deere. The vehicle cooling system which is accommodated in an engine compartment has a first cooler arrangement and a second cooler arrangement accommodated spatially separately therefrom. The first cooler arrangement comprises, inter alia, in addition to a high-temperature heat exchanger for cooling a diesel engine, an oil cooler and an air-conditioning system condenser, wherein the relevant cooler components lie in series and/or in parallel in a common main cooling flow which is generated by means of an axial fan by taking in ambient air. The second cooler arrangement has a charge air cooler which is mounted inside the engine compartment running upstream and substantially horizontally above the main cooling flow. In order to permit operation of the charge air cooler independently of the first cooler arrangement, a further axial fan which is driven by means of a hydraulic motor is connected upstream of said charge air cooler. In this way, a secondary cooling flow passing through the charge air cooler can be branched off from the main cooling flow. The heated secondary cooling flow subsequently leaves the engine compartment via an air outlet opening which is formed on an upper side of an engine hood.

To protect the cooler arrangements of the vehicle cooling system against dust deposits and an associated degradation of the cooling efficiency, the ambient air is taken in via a filter element. The latter is in the form of a fine-mesh metal screen which is designed as a particle filter and is located directly behind a front-side radiator grille in the engine hood of the agricultural tractor. Since the surface of the metal screen becomes clogged over time as dust-containing ambient air passes through it, the filter element has to be cleaned at regular temporal intervals, for which purpose, on the basis of a time sequence control, an appropriate instruction to the driver can be output via a user interface located in a driver's cab. The cleaning operation per se is conventionally carried out manually by means of a blow-off gun fed with compressed air by a compressor. Some vehicle cooling systems, however, also provide the option, by pivoting associated fan vanes, of setting the axial fan of the first cooling arrangement into a reversing operation in which the direction of the main cooling flow is reversed such that the filter element can be blown off toward the external environment and thereby cleaned.

In order to take into account the dust accumulations occurring at the filter element between consecutive cleaning operations, and also the fact that the observing of the cleaning intervals is ultimately up to the operator, the maximum cooling capacity which can be provided by the vehicle cooling system has to be appropriately over dimensioned to ensure sufficient "safety reserves". Regarding the second cooler arrangement, which is adjacent to the main cooling flow or projects into the latter, is intended to be structurally compact for avoiding any potential undesirable impairments of the cooling of the first cooler arrangement.

Against this background, it is the object of the present disclosure to develop a method for operating a vehicle cooling system of the type mentioned at the beginning in respect of optimizing the construction space.

This object is achieved by the following apparatus and methods.

In the case of the method for operating a vehicle cooling system, the vehicle cooling system comprises a first fan assembly for generating a main cooling flow acting upon a first cooler arrangement, and a second fan assembly which is adjacent to the main cooling flow for generating a secondary cooling flow acting upon a second cooler arrangement, the secondary cooling flow being branched off from the main cooling flow by means of the second fan assembly, and the ambient air taken in for generating the cooling flows passing through a filter element which is located upstream of the fan assemblies and of the cooler arrangements for filtering particles. An actual value of a rotational speed variable which is determined by a sensor and/or computer and which reproduces a rotational speed occurring at the second fan assembly depending on the cooling requirement is compared by a control unit with a desired value specified for a cleaned state of the filter element, wherein, in the event that the comparison result lies outside a predetermined rotational speed tolerance range, a trigger signal is generated by the control unit to initiate a reversing operation of the first fan assembly in order to blow out the filter element by means of the first fan assembly by reversing the direction of the main cooling flow.

In other words, an excessive increase in the cooling requirement of the second cooler arrangement, which increase is derived from a rotational speed discrepancy observed, is used as an indicator of the necessity for carrying out an operation to clean the filter element. This procedure takes into consideration the actual particle loading of the ambient air taken in, which, of course, is not the case for a pure time sequence control or the like. The required over dimensioning of the second cooler arrangement including the associated second fan assembly is calculated here by way of the safety reserve provided by the permissible rotational speed tolerance range, i.e., can turn out to be accordingly structurally compact.

In this case, the cooling requirement dependency of the rotational speed of the second fan assembly arises from the fact that, in customary vehicle cooling systems, a reduced cooling power, which is identified on the basis of a rise in temperature, is compensated for by a successive increase in the rotational speed.

The second cooler arrangement can be a charge air cooler of a diesel engine. This is used for cooling the combustion air which is heated during compression by means of a turbocharger and is to be supplied to an intake tract of the diesel engine. The second fan assembly is designed here as a hydraulically or electrically driven axial fan.

In order to carry out the reversing operation, the first fan assembly, which is likewise designed as an axial fan, can have a plurality of fan vanes which project radially from a fan hub and can be pivoted with respect to their angle of attack by means of an actuating device. In this way, a reversal of the flow direction is possible without changing the direction of rotation of the axial fan. The latter is set into rotation here via a belt drive connected to the diesel engine.

Additional embodiments of the apparatus and methods according to the disclosure are described herein.

In some embodiments, the actual value of the rotational speed variable is determined by the control unit by a sensor by detecting a rotational speed of a fan wheel included by the second fan assembly. For this purpose, use can be made of an inductive rotational speed sensor of conventional design which contactlessly detects the revolutions of a drive shaft running between fan drive and fan wheel and transmits a rotational speed signal corresponding thereto to the control unit.

In some embodiments, it is also conceivable that the actual value of the rotational speed variable is determined by the control unit by computer in accordance with a control variable provided for operating the second fan assembly. If the fan wheel is driven hydraulically, the control variables can represent a volumetric flow and/or a pressure of a hydraulic supply provided for operating an associated hydraulic motor. Said control variables can be indirectly derived, for example, from an electric signal serving to actuate a valve provided for predetermining a volumetric flow and/or pressure. By contrast, if the fan wheel is driven electrically, the control variables arise from voltage and/or current of a power supply provided for operating an associated electric motor. The relevant variables can be readily detected by a sensor and, when the control behavior of the hydraulic or electric motor is known, permit an unambiguous statement about the rotational speed occurring at the fan wheel.

In some embodiments, there is the option that the desired value of the rotational speed variable that is specified for a cleaned state of the filter element is fixedly predetermined for the sake of simplicity. The desired value is specified in such a manner that a maximum anticipated cooling requirement of an operating device to be cooled by means of the second cooler arrangement or of an operating medium to be cooled by means of the second cooler arrangement is reliably covered. The desired value predetermined for the rotational speed variable is stored, for example, in a memory unit communicating with the control unit.

In some embodiments, it is also conceivable that the desired value of the rotational speed variable that is specified for a cleaned state of the filter element is not fixedly oriented to the maximum cooling requirement of the operating device to be cooled by means of the second cooler arrangement or of the operating medium to be cooled by means of the second cooler arrangement, but rather is variably predetermined by the control unit depending on a determined actual cooling requirement. If the second cooler arrangement is a charge air cooler, the actual cooling requirement of the charge air can be derived, inter alia, from details in respect of an engine rotational speed or power of the diesel engine, the external temperature, the air humidity, the charge air pressure and/or the position of adjustable turbocharger vanes.

To initiate the cleaning operation, it can be provided that a user interface for outputting operator information informing of the necessity of carrying out a reversing operation is activated by means of the trigger signal. The user interface has, for example, a touch-sensitive display which is accommodated in a driver's cab of a utility vehicle equipped with the vehicle cooling system or else is part of a mobile terminal which is connected in terms of data exchange to the control unit via a wireless interface. The operator information is output visually via the touch-sensitive display, but optionally also audibly by means of an acoustic signal generator included by the user interface.

In some embodiments, there is the option that an actuating device included by the first fan assembly and intended for automatically carrying out the reversing operation is activated by means of the trigger signal. For this purpose, the actuating device comprises an electrically, hydraulically, or pneumatically actuable arrangement, integrated in a fan hub of the fan wheel, for changing the angle of attack of the fan vanes. The arrangement is actuated electrically, hydraulically, or pneumatically here by means of a controller unit which is connected to the control unit.

Since the carrying out of the cleaning operation necessitates a temporary interruption to the operation of a utility vehicle equipped with the vehicle cooling system, there can be an advantage if the reversing operation is automatically carried out by the control unit after or only after previous enabling by the operator. For the purposes of enabling by the operator, use can be made of the touch-sensitive display included by the user interface. In this case, the driver of the utility vehicle obtains the opportunity of searching for a suitable parking space so that an undesirable blowing off of the filter element in closed buildings, such as barns or workshops, can be prevented.

The above and other features will become apparent from the following detailed description and accompanying drawings.

BRIEF DESCRIPTION OF THE DRAWINGS

The method according to the disclosure for operating a vehicle cooling system will be described in more detail below on the basis of the appended drawings. Here, identical reference designations relate to corresponding components or components which are of comparable function. In the drawings.

DETAILED DESCRIPTION

The embodiments or implementations disclosed in the above drawings and the following detailed description are not intended to be exhaustive or to limit the present disclosure to these embodiments or implementations.

Figure 1:
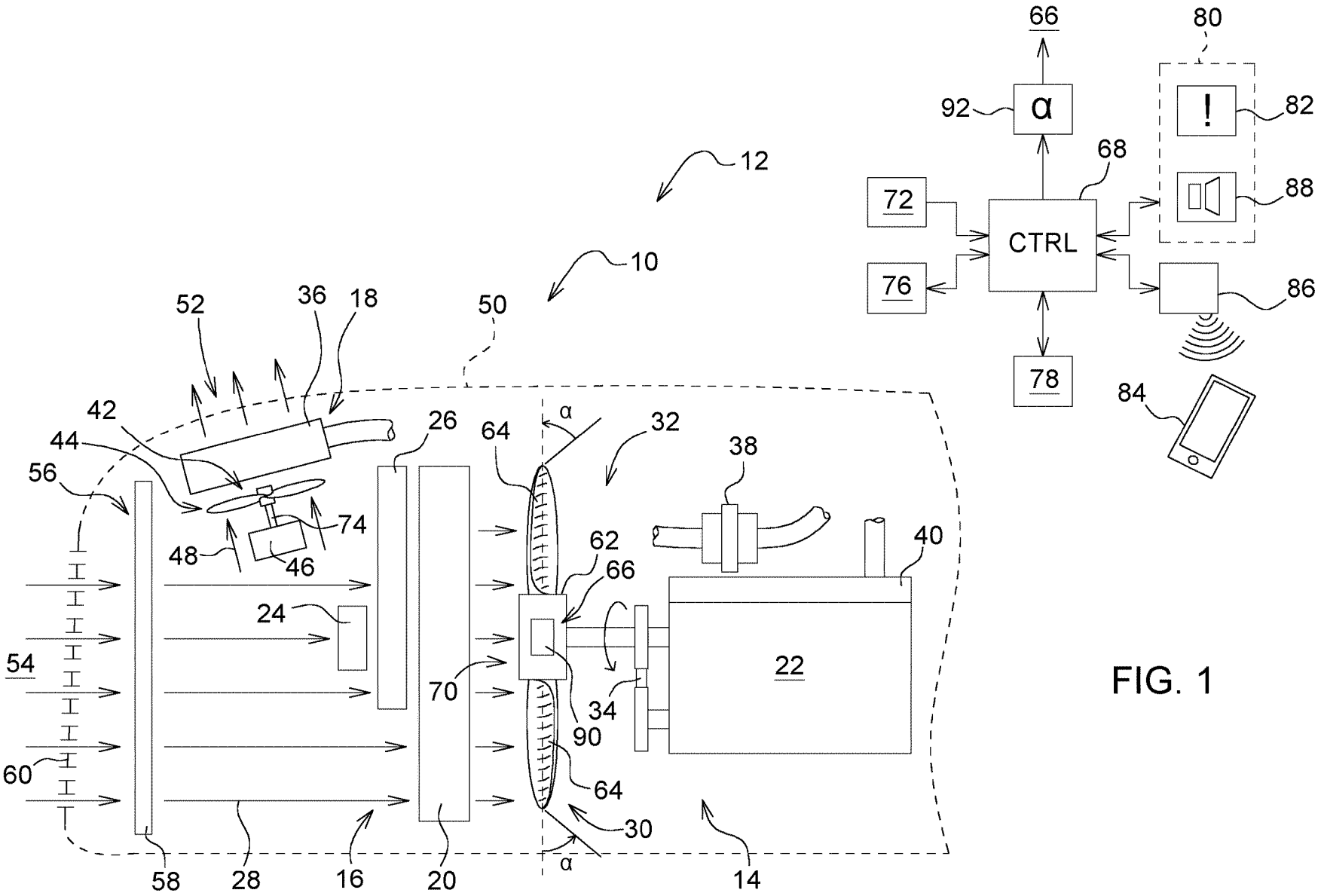
FIG. 1 shows a schematically illustrated vehicle cooling system of a utility vehicle in the form of an agricultural tractor.

FIG. 1 shows a schematically illustrated vehicle cooling system 10 which is part of a utility vehicle in the form of an agricultural tractor 12.

The illustration of an agricultural tractor 12 is merely of an exemplary nature; it may, on the contrary, also be any other utility vehicle from the agricultural or forestry sphere, and also a construction vehicle.

The vehicle cooling system 10 which is accommodated in an engine compartment 14 of the agricultural tractor 12 has a first cooler arrangement 16 and a second cooler arrangement 18 accommodated spatially separately therefrom. The first cooler arrangement 16 comprises, inter alia, in addition to a high-temperature heat exchanger 20 for cooling a diesel engine 22, an oil cooler 24 and an air-conditioning system condenser 26, wherein the relevant cooler components lie in series and/or in parallel in a common main cooling flow 28 which is generated by means of a first fan assembly 32 designed as an axial fan 30. The axial fan 30 is set into rotation here via a belt drive 34 connected to the diesel engine 22.

Furthermore, the second cooler arrangement 18 is a charge air cooler 36 which is mounted adjacent inside the engine compartment 14 running upstream and substantially horizontally above the main cooling flow 28. The charge air cooler 36 serves for cooling the combustion air which is heated by means of a turbocharger 38 during the compression and is to be supplied to an intake tract 40 of the diesel engine 22 (the hose connections present in this respect are merely indicated for the sake of clarity in FIG. 1). In order to permit operation of the charge air cooler 36 which is independent of the first cooler arrangement 16, a second fan assembly 42 in the form of a further axial fan 44 which is driven by means of a hydraulic motor 46 is connected upstream. Instead of such a hydraulic drive, however, an electric drive in the form of an electric motor may also be provided. In this way, a secondary cooling flow 48 passing through the charge air cooler 36 is branched off from the main cooling flow 28. The heated secondary cooling flow 48 subsequently leaves the engine compartment 14 via an air outlet opening 52 which is formed on an upper side of an engine hood 50 (indicated by dashed lines).

To protect the cooler arrangements 16, 18 of the vehicle cooling system 10 against dust deposits and an associated degradation of the cooling power, the ambient air 54 required for generating main and secondary cooling flows 28, 48 is taken in via a filter element 56 lying upstream of the fan assemblies 32, 42 and the cooler arrangements 16, 18. The filter element 56 is in the form of a fine-mesh metal screen 58 which is designed as a particle filter and is located directly behind a front-side radiator grille 60 in the engine hood 50 of the agricultural tractor 12. In a departure therefrom, the filter element 56 can also be structurally integrated directly in the front-side radiator grille 60.

Since the surface of the metal screen 58 becomes clogged over time as dust-containing ambient air 54 passes through it, the filter element 56 has to be cleaned at regular intervals. For this purpose, the vehicle cooling system 10 provides the option of setting the axial fan 30 of the first cooling arrangement 16 into a reversing operation in which the direction of the main cooling flow 28 is reversed such that the filter element 56 can be blown off toward the external environment and thereby cleaned.

Figure 2:
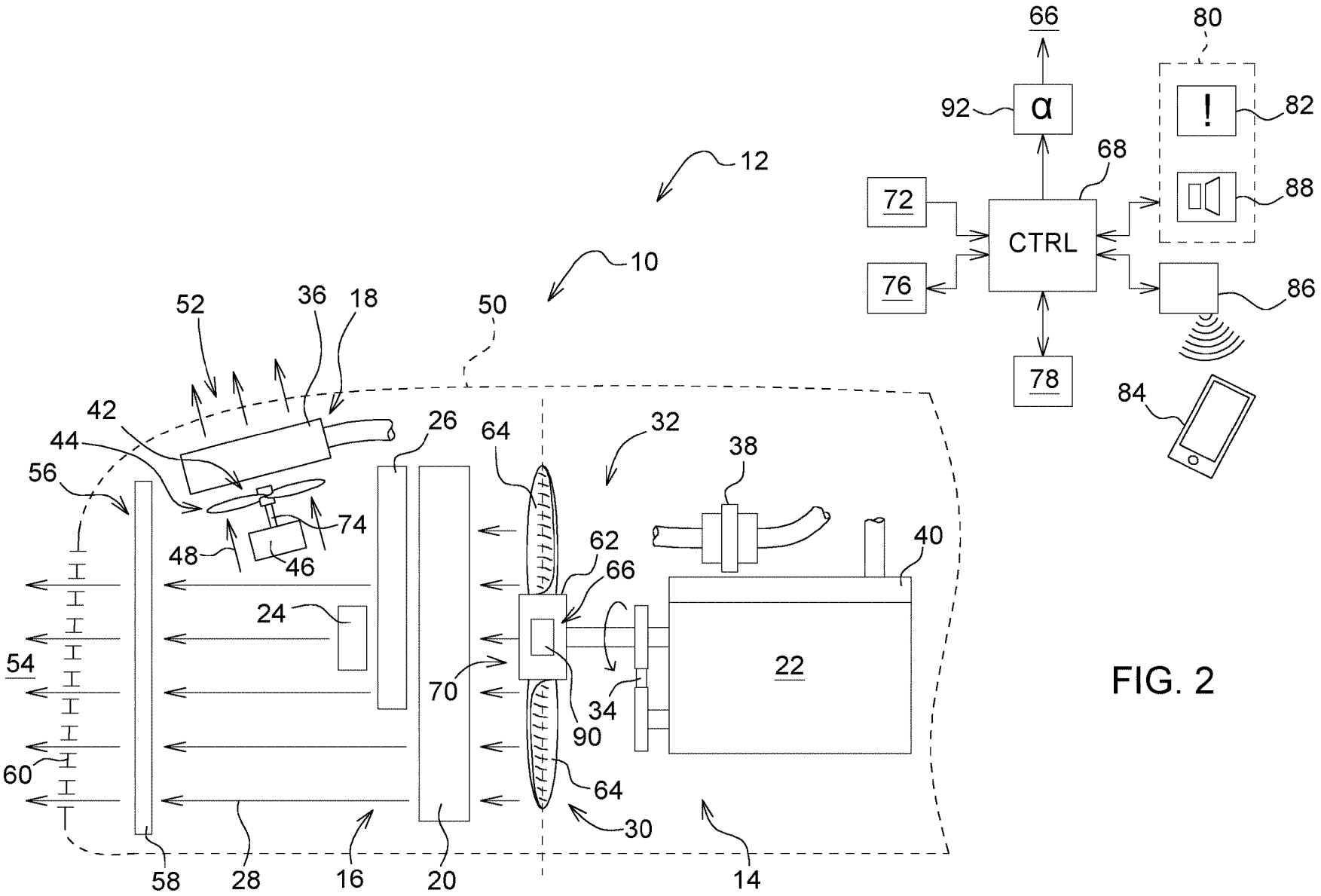
FIG. 2 shows the vehicle cooling system shown in FIG. 1 during the carrying out of a reversing operation.

For example, the axial fan 30 included by the first fan assembly 32 and intended for carrying out the reversing operation has a plurality of fan vanes 64 which project radially at a fan hub 62 and can be pivoted with respect to their angle of attack a by means of an actuating device 66. In this way, a reversal of the flow direction is possible without changing the direction of rotation of the axial fan 30. This operating state is reproduced in FIG. 2.

For the sake of completeness, it should be noted that the spatial arrangement of the fan assemblies 32, 42 and cooler arrangements 16, 18 illustrated in FIG. 1 reproduces one of a plurality of options. In the present case, the second cooler arrangement 18 is located with respect to the course of the main cooling flow 28 between the filter element 56 and the first cooler arrangement 16, but may also be located between the first cooler arrangement 16 and the first fan assembly 32.

The function of the further components illustrated in FIG. 1 will be explained below in conjunction with the method sequence reproduced in FIG. 3.

Figure 3:
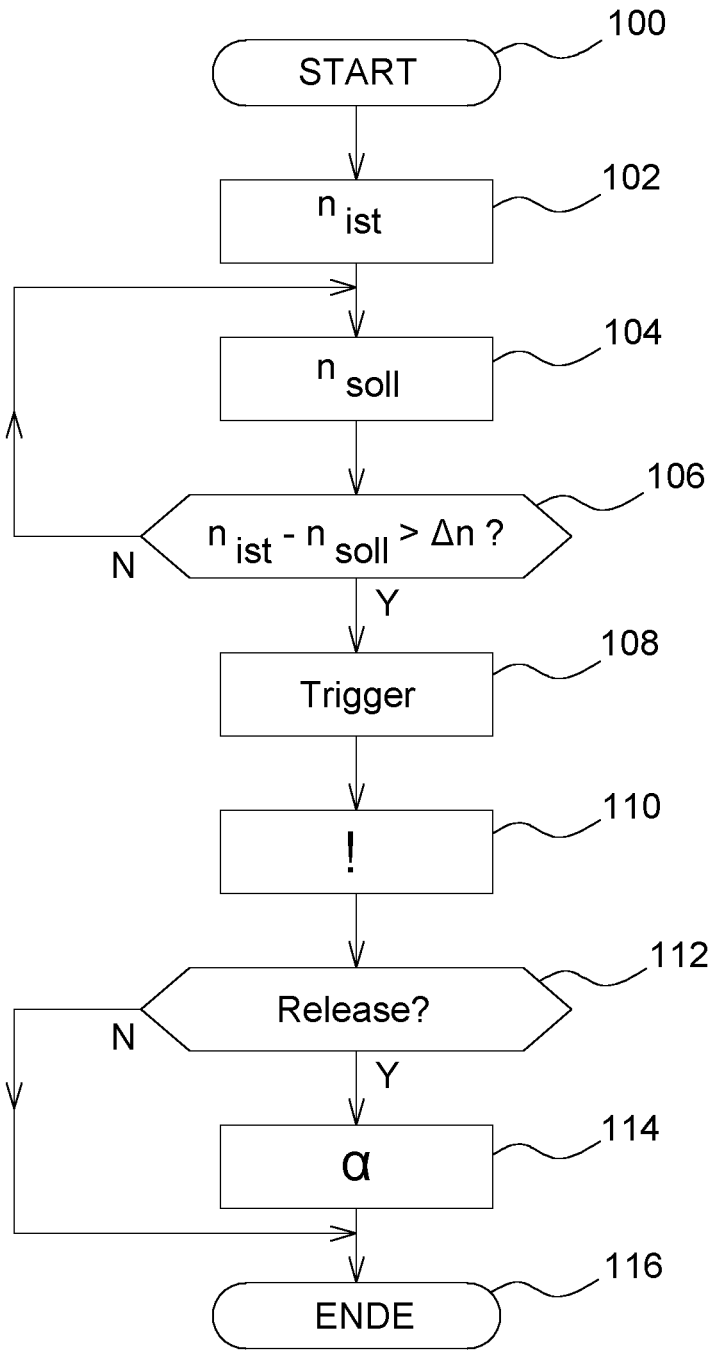
FIG. 3 shows an exemplary embodiment, illustrated as a flow diagram, of the method according to the disclosure for operating the vehicle cooling system shown in FIG. 1.

FIG. 3 shows here an exemplary embodiment, illustrated as a flow diagram, of the method according to the disclosure for operating the vehicle system 10. According thereto, the method is started in an initialization step 100, whereupon, in a first step 102, an actual value $n_{act}$ of a rotational speed variable which reproduces a rotational speed occurring at the second fan assembly 42, depending on the cooling requirement, is determined by a control unit 68 (e.g., a controller including a processor and memory). The cooling requirement dependency of the rotational speed of the second fan assembly 42 arises in the present case from the fact that a reduced cooling power, which is identified on the basis of a rise in temperature, is compensated for by a successive increase in the rotational speed.

The actual value $n_{act}$ of the rotational speed variable is determined in the first step 102 by the control unit 68 by a sensor by detecting the rotational speed of a fan wheel 70 included by the second fan assembly 42. For this purpose, use is made of an inductive rotational speed sensor 72 of conventional design which contactlessly detects the revolutions of a drive shaft 74 running between hydraulic motor 46 and fan wheel 70 and transmits a rotational speed signal corresponding thereto to the control unit 68.

Alternatively, the actual value $n_{act}$ of the rotational speed variable is determined by the control unit 68 in the first step 102 by computer in accordance with control variables provided for operation of the second fan assembly 42. The control variables present at a CAN data bus 76 of the agricultural tractor 12 are detected by a sensor and, when the control behavior of the hydraulic motor 46 is known, permit an unambiguous statement about the rotational speed occurring at the fan wheel 70. The control variables here represent a volumetric flow and/or pressure of a hydraulic supply provided for operating the hydraulic motor 46. Said control variables here are indirectly derived by the control unit 68 from an electric signal serving to actuate a valve (not shown) provided for predetermining a volumetric flow and/or pressure. By contrast, if an electric motor is used, the control variables arise from voltage and/or current of a power supply provided for operating same.

In a second step 104, the actual value $n_{act}$ of the rotational speed variable that is determined in the first step 102 is compared by the control unit 68 with a desired value $n_{des}$ specified for a cleaned state of the filter element 56.

If the control unit 68, in a third step 106, recognizes that the comparison result lies outside a predetermined rotational speed tolerance range $\Delta n$, it generates, in a fourth step 108, a trigger signal for initiating a reversing operation of the first fan assembly 32 in order to blow off the filter element 56 by means of the first fan assembly 32 by reversing the direction of the main cooling flow 28. Otherwise, the method returns again to the third step 106.

In other words, an excessive increase in the cooling requirement of the second cooler arrangement 18, which increase is derived from a rotational speed discrepancy observed in the fourth step 108, is used as an indicator of the necessity for carrying out an operation to clean the filter element 56.

According to a first option, the desired value $n_{des}$ of the rotational speed variable that is specified for a cleaned state of the filter element 56 is fixedly predetermined. The desired value $n_{des}$ is specified in such a manner that a maximum anticipated cooling requirement of the charge air to be cooled by means of the second cooler arrangement 18 is reliably covered. The desired value $n_{des}$ predetermined for the rotational speed variable is stored in a memory unit 78 communicating with the control unit 68.

In a departure therefrom, a second option makes provision that the desired value $n_{des}$ of the rotational speed variable that is specified for a cleaned state of the filter element 56 is not fixedly oriented to the maximum cooling requirement of the charge air to be cooled by means of the second cooler arrangement 18, but rather is variably predetermined by the control unit 68 depending on a determined actual cooling requirement. The actual cooling requirement of the charge air is derived by the control unit 68 inter alia from details available via the CAN data bus 76 in respect of an engine rotational speed or engine power of the diesel engine 22, the external temperature, the air humidity, the charge air pressure and/or the position of adjustable turbocharger vanes.

To initiate the cleaning operation, it is provided, in a fifth step 110, that a user interface 80 for outputting operator information informing of the necessity of carrying out a reversing operation is activated by means of the trigger signal. The user interface 80 has a touch-sensitive display 82 which is accommodated in a driver's cab of the agricultural tractor 12 or else is part of a mobile terminal 84 which is connected in terms of data exchange to the control unit 68 via a wireless interface 86. The operator information is output visually via the touch-sensitive display 82, but also audibly by means of an acoustic signal generator 88 included by the user interface 80.

In this connection, in a seventh step 114, after enabling by an operator in an upstream sixth step 112, the actuating device 66 included by the first fan assembly 32 and intended for automatically carrying out the reversing operation is activated by means of the trigger signal. For this purpose, the actuating device 66 comprises an electrically, hydraulically, or pneumatically actuable arrangement 90, integrated in the fan hub 62 of the fan wheel 70, for changing the angle of attack a of the fan vanes 64. The arrangement 90 is actuated electrically, hydraulically, or pneumatically here by means of a controller unit 92 which is connected to the control unit 68. If the enabling by an operator is not carried out in the sixth step 112, the method is ended directly in a concluding step 116.

The touch-sensitive display 82 included by the user interface 80 is used for the enabling by the operator in the sixth step 112. In this case, the driver of the agricultural tractor 12 obtains the opportunity of searching for a suitable parking space so that an undesirable blowing off of the filter element 56 in closed buildings, such as barns or workshops, can be prevented.

Subsequently, the method according to the disclosure is ended in the concluding step 116.

The terminology used herein is for the purpose of describing example embodiments or implementations and is not intended to be limiting of the disclosure. As used herein, the singular forms "a," "an," and "the" are intended to include the plural forms as well, unless the context clearly indicates otherwise. It will be further understood that the any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof.

Those having ordinary skill in the art will recognize that terms such as "above," "below," "upward," "downward," "top," "bottom," etc., are used descriptively for the figures, and do not represent limitations on the scope of the present disclosure, as defined by the appended claims. Furthermore, the teachings may be described herein in terms of functional and/or logical block components or various processing steps, which may include any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described embodiments or implementations.

As used herein, "e.g.," is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example embodiments or implementations of the present disclosure, these descriptions should not be viewed in a restrictive or limiting sense. Rather, there are several variations and modifications which may be made without departing from the scope of the appended claims.

What is claimed is:

1. A vehicle cooling system comprising:

a first fan assembly generating a main cooling flow acting upon a first cooler arrangement;

a second fan assembly generating a secondary cooling flow adjacent to the main cooling flow and acting upon a second cooler arrangement, the secondary cooling flow being branched off from the main cooling flow via the second fan assembly, the main and secondary cooling flows passing through a filter element located upstream of the first and second fan assemblies and the first and second cooler arrangements; and a control unit configured to determine an actual value of a rotational speed variable of the second fan assembly, compare the actual value with a desired value specified for a cleaned state of the filter element, and generate a trigger signal to initiate a reversing operation of the first fan assembly in order to blow out the filter element by means of the first fan assembly by reversing the direction of the main cooling flow when the comparison result lies outside a predetermined rotational speed tolerance range.

2. The system of claim 1, wherein the actual value of the rotational speed variable is determined via the control unit communicating with a sensor detecting a rotational speed of the second fan assembly.

3. The system of claim 1, wherein the actual value of the rotational speed variable is determined via the control unit based on a control variable for operating the second fan assembly.

4. The system of claim 1, wherein the desired value of the rotational speed variable that is specified for a cleaned state of the filter element is fixedly predetermined.

5. The system of claim 1, wherein the desired value of the rotational speed variable that is specified for a cleaned state of the filter element is variably predetermined by the control unit depending on a determined actual cooling requirement.

6. The system of claim 1, wherein a user interface for outputting operator information informing of the necessity of carrying out a reversing operation is activated by means of the trigger signal.

7. The system of claim 1, wherein an actuating device intended for automatically carrying out the reversing operation is activated by means of the trigger signal.

8. The system of claim 7, wherein the reversing operation is automatically carried out by the control unit after previous enabling by the operator.

9. A method for operating a vehicle cooling system comprising:

generating via a first fan assembly a main cooling flow acting upon a first cooler arrangement;

generating via a second fan assembly a secondary cooling flow adjacent to the main cooling flow and acting upon a second cooler arrangement, the secondary cooling flow being branched off from the main cooling flow via the second fan assembly;

passing the main and secondary cooling flows through a filter element located upstream of the first and second fan assemblies and the first and second cooler arrangements;

determining via a control unit an actual value of a rotational speed variable of the second fan assembly;

comparing via the control unit the actual value with a desired value specified for a cleaned state of the filter element; and generating via the control unit a trigger signal to initiate a reversing operation of the first fan assembly in order to blow out the filter element by means of the first fan assembly by reversing the direction of the main cooling flow when the comparison result lies outside a predetermined rotational speed tolerance range.

10. The method of claim 9, wherein the actual value of the rotational speed variable is determined via the control unit communicating with a sensor detecting a rotational speed of the second fan assembly.

11. The method of claim 9, wherein the actual value of the rotational speed variable is determined via the control unit based on a control variable for operating the second fan assembly.

12. The method of claim 9, wherein the desired value of the rotational speed variable that is specified for a cleaned state of the filter element is fixedly predetermined.

13. The method of claim 9, wherein the desired value of the rotational speed variable that is specified for a cleaned state of the filter element is variably predetermined by the control unit depending on a determined actual cooling requirement.

14. The method of claim 9, wherein a user interface for outputting operator information informing of the necessity of carrying out a reversing operation is activated by means of the trigger signal.

15. The method of claim 9, wherein an actuating device intended for automatically carrying out the reversing operation is activated by means of the trigger signal.

16. The method of claim 15, wherein the reversing operation is automatically carried out by the control unit after previous enabling by the operator.

* * * * *